US007707675B2

(12) United States Patent
Van Bogaert

(10) Patent No.: US 7,707,675 B2
(45) Date of Patent: May 4, 2010

(54) PIPE-CLEANING DEVICE

(76) Inventor: Rafaël Van Bogaert, Kemelstraat 68, B-9160, Stekene (BE)

( * ) Notice: Subject to any disclaimer, the term of this patent is extended or adjusted under 35 U.S.C. 154(b) by 1211 days.

(21) Appl. No.: 10/537,024

(22) PCT Filed: Dec. 10, 2003

(86) PCT No.: PCT/BE03/00216

§ 371 (c)(1),
(2), (4) Date: Jun. 1, 2005

(87) PCT Pub. No.: WO2004/052565

PCT Pub. Date: Jun. 24, 2004

(65) Prior Publication Data

US 2006/0042032 A1 Mar. 2, 2006

(30) Foreign Application Priority Data

Dec. 10, 2002 (NL) ..... 1022126

(51) Int. Cl.
*B08B 9/051* (2006.01)

(52) U.S. Cl. ..... 15/104.12; 15/104.09; 15/104.05

(58) Field of Classification Search ..... 15/104.9, 15/104.12, 104.05, 104.07, 104.31, 104.061; 134/167 C, 168 C See application file for complete search history.

(56) References Cited

U.S. PATENT DOCUMENTS 3,525,111 A * 8/1970 Arx Von ..... 15/104.061
3,885,521 A * 5/1975 von Arx ..... 118/105
4,249,475 A * 2/1981 Lindsey ..... 118/105
5,903,946 A * 5/1999 Collins et al. ..... 15/104.061
6,966,950 B2 * 11/2005 Winiewicz et al. ..... 118/712

FOREIGN PATENT DOCUMENTS

CH 290404 4/1953
GB 851847 10/1960

* cited by examiner

*Primary Examiner*—Dung Van Nguyen
(74) *Attorney, Agent, or Firm*—Dykema Gossett PLLC

(57) ABSTRACT

A pipe-cleaning device (1) comprising a cutting head (2) for cutting away material on the interior of a pipe, a body (111) on which the cutting head is rotatably mounted and drive means (3, 4) for driving the rotation of the cutting head (2) with respect to the body (111). In a first aspect the cutting head (2) is provided with one or more inwardly collapsible cutting elements (21) and the body (111) has a plurality of arrays of inwardly collapsible support elements (30) extending in longitudinal direction of the body (111) for supporting the body (111) on the interior of a pipe. In a second aspect the cutting head (2) comprises at least one first collapsible cutting element (21) which extends radially from a rigid central part (11), ends in a first cutting block (22) and is provided with at least one mass increasing element (22) at an intermediate location. In a third aspect, the drive means comprise a stator (3) and a rotor (4), the stator having at least one nozzle (7) for directing a liquid stream successively onto a plurality of drive elements (5) of the rotor (4), the at least one nozzle (7) extending substantially within a plane (V) perpendicular to the rotation axis (9) of the rotor and being located inwardly from the rotor (4).

17 Claims, 3 Drawing Sheets

PIPE-CLEANING DEVICE

BACKGROUND OF THE INVENTION

1. Field of the Invention

The present invention relates to a pipe-cleaning device comprising a rotatable cutting head for cutting away material on the interior of a pipe, such as for example tree roots on the interior of a sewage pipe. The invention further relates to a cutting head mountable on a pipe-cleaning device and a drive for driving the cutting head of a pipe-cleaning device.

2. The Prior Art

From U.S. Pat. No. 5,713,093 a pipe-cleaning device is known which comprises a cutting head for cutting away material on the interior of a pipe, a body on which the cutting head is rotatably mounted and drive means using a pressurized liquid for driving the rotation of the cutting head with respect to the body. The cutting head is made up of rigid cutting elements extending throughout the diameter of the device and the body is circumferentially provided with rigid guide runners means for supporting the body on the interior of the pipe to be cleaned.

The pipe-cleaning device known from U.S. Pat. No. 5,713,093 has the disadvantage that it cannot be moved past certain obstructions which may occur in the interior of pipes. An example of such an obstruction is a subsidence of one pipe section with respect to an adjacent pipe section, which is for example common in sewage pipes. With the prior art device, there is a risk that the device comes to a standstill at such obstructions.

The pipe-cleaning device known from U.S. Pat. No. 5,713,093 further has the disadvantage that the cutting head is unsuitable for cutting away large obstructions.

Another disadvantage of the pipe-cleaning device known from U.S. Pat. No. 5,713,093 is that the amount of torque which can be developed for cutting away material from the interior of the pipe remains limited.

It is a first aim of the present invention to provide a pipe-cleaning device with which the risk that the device comes to a standstill at obstructions can be reduced.

It is a second aim of the present invention to provide a cutting head for a pipe-cleaning device with improved cutting action.

It is a third aim of the present invention to provide a drive for driving the rotation of a cutting head of a pipe-cleaning device with which the developed amount of torque can be increased.

SUMMARY OF THE INVENTION

According to the first aspect of the invention, the pipe-cleaning device comprises a cutting head with collapsible cutting elements and a body with collapsible support elements. The collapsible cutting elements extend in radial direction of the cutting head and are inwardly collapsible with respect to the circumference of the body on which the cutting head is mounted. The collapsible support elements are provided in a plurality of arrays on the body, each array extending over substantially the entire length of the body. The collapsible support elements are inwardly collapsible with respect to the circumference of the body against the action of a resilient member.

The pipe-cleaning device of the invention is capable of passing obstructions like for example subsided pipe sections by the collapsibility of the cutting elements on the head and the support elements over the whole length of the body. In this way, the diameter of the pipe-cleaning device is variable over its entire length. However, it has to be made sure that the body of the pipe-cleaning device is sufficiently supported on the interior of the pipe, even if one or more of the supporting elements have collapsed. This is achieved by arranging the supporting elements in arrays, so that the obstruction is taken by one supporting element after the other, and providing each element with a resilient member for counteracting the collapsing, so that after having taken the obstruction the support element is returned to its original position. In other words, the supporting function of one support element is for a short while taken over by the other support elements of the array.

The pipe-cleaning device of the first aspect of the invention preferably comprises at least three arrays of at least three collapsible support elements, the arrays being located at regular locations on the circumference of the body. The device may however also be provided with any other number of arrays having any other number of supporting elements as deemed suitable by the person skilled in the art.

The collapsible support elements preferably comprise a wheel which is rotatably mounted on a collapsible arm, which is in turn pivotally mounted on the body. The rotation axis of the wheel is offset from the pivot axis in longitudinal direction of the body, so that the collapsibility of the wheel is enhanced and it can be further ensured that the pipe-cleaning device does not come to a standstill at large obstructions.

The resilient member is preferably a pull spring. The pull spring preferably extends in line with the collapsible arm in unloaded state. In this way, the pull force, which occurs when the wheel engages an obstruction and collapses and which pulls the arm and the wheel back to their original positions, is small initially and increases as the wheel collapses further. This helps to ensure that the wheel can collapse and is quickly returned to its original position afterwards.

Preferably, the collapsible support elements at the front end of the device, i.e. at the cutting head collapse in rearward direction whereas the collapsible support elements at the rear end collapse in forward direction. This has the advantage that the first support element which engages an obstruction always collapses in the opposite direction from the direction in which the pipe-cleaning device is moving, so that the device can easily be moved both forwards and backwards substantially without risk that the device comes to a standstill or becomes stuck at obstructions.

According to the second aspect of the invention, the cutting head comprises at least one first collapsible cutting element which extends radially from a rigid central part. Each of these first collapsible cutting elements ends in a first cutting block and is provided with at least one mass increasing element at an intermediate location between the central part and the first cutting block. With a mass increasing element is meant that the mass of the collapsible cutting element at the intermediate location is higher than in between the intermediate location and the central part of the cutting head, or in between the intermediate location and the outer cutting block. Each collapsible cutting element may be provided with one or more mass increasing elements, but for the sake of clarity only one mass increasing element is used for the explanation below.

By providing the collapsible cutting element with the mass increasing element, the kinetic energy of the chain during rotation is increased. This has the advantage that, when the outer cutting block strikes an object, the cutting element will have less tendency to bend or to collapse at the central part. The inertia of the cutting element at the mass increasing element is increased, so that the bending will occur at the mass increasing element. In other words, due to the mass increasing element, the inner part of the collapsible cutting element between the central part and the mass increasing element will be disturbed to a lesser extent than the outer part between the mass increasing element and the outer cutting block. As a result, the cutting element can return more quickly to its desired fully extended position as a result of centrifugal forces, for again striking the object to be removed. This shows that with the cutting head of the second aspect of the invention an improved cutting action can be achieved.

Preferably, the mass increasing elements form second cutting blocks, so that they have a double function: avoiding undesired collapsing of the cutting element and providing cutting action at a shorter diameter from the outer cutting blocks. This can further enhance the cutting action.

The first collapsible cutting elements preferably comprise a first chain part extending from the first, outer cutting block to the mass increasing element or second cutting block, and a second chain part extending from the mass increasing element to the central part of the cutting head. The weight of the first, outer chain part including the first, outer cutting block is preferably smaller than or equal to the weight of the second, inner chain part including the mass increasing element. In this way, the disturbance of the inner chain part when the outer cutting block strikes an object is reduced to a minimum.

The cutting head preferably comprises at least one second collapsible cutting element of shorter length at its front. More particularly, the length of the second collapsible cutting elements, which also comprise a chain part ending in a cutting block, is preferably substantially equal to that of the inner chain part of the first collapsible cutting elements. Providing these shorter collapsible cutting elements at the front has the advantage that the load on of the first collapsible cutting elements is reduced, so that their bending towards the back can be reduced. This can further improve the cutting action of the cutting head.

Any of the cutting blocks, whether at the end of the collapsible cutting elements or at an intermediate location, may be provided with a cutting protrusion, which extends towards the front of the cutting head, for providing additional cutting action.

According to the third aspect of the invention, the drive, which is provided in the pipe-cleaning device for driving its cutting head, comprises a stator and a rotor rotatably mounted on the stator. The stator has at least one nozzle connected to a supply duct, via which a pressurised liquid is supplied, for directing a liquid stream successively onto a plurality of drive elements of the rotor. The nozzles extend substantially within a plane perpendicular to the rotation axis of the rotor and is located inwardly from the rotor.

Since the one or more nozzles of the stator of the drive of the invention are provided within the plane in which the rotor rotates, more particularly on its interior, the rotor is driven by forces which are located substantially perpendicular to its rotation axis. As a result, the driving forces are directed in the direction in which the drive elements of the rotor move during rotation. As a result, the torque which is developed by the rotor can be maximised.

Furthermore, by driving the rotor from its inside, the drive elements on the rotor can be positioned as far as possible towards its circumference, so that the torque arm is prolonged and the torque can be further enhanced.

The drive plane of each drive element of the rotor is preferably directed such that it receives the liquid stream in a substantially perpendicular direction. This means that the drive elements are oriented in such a way on the rotor, that the liquid streams hit them in a substantially perpendicular direction and as much force as possible is transferred to the drive elements. In this way, the torque can be further enhanced.

The drive planes are preferably directed in an angle $\alpha$ of 20-70°, more preferably 30-60°, most preferably 40-50°, with respect to the circular path along which they travel during operation. The nozzles are preferably directed in an angle $\beta$ of 45-90°, more preferably 60-80° with respect to this circular path. The angles $\alpha$ and $\beta$ may however also be wider or narrower.

Each drive element of the rotor has a leading edge which is rotated first into the liquid stream of the nozzle during operation. This leading edge is preferably bevelled in a direction towards the drive plane of the in rotation direction previous drive element of the rotor. This has the advantage that the drive element forms less of an obstruction when it is rotated into the liquid stream and also that the liquid which is diverted by the previous drive element is less obstructed. In this way, the friction losses can be reduced and the torque developed by the rotor can be further enhanced. Furthermore, the reduced friction leads to less wear on the drive elements, so that the life of the drive of the invention can be prolonged.

In order to reduce the pressure loss which occurs at the end of the nozzles, where the drive liquid leaves the nozzles and is urged onto the drive elements, the distance x between the nozzle and the leading edge of the drive elements is kept as low as possible. The distance x is preferably between 1-5 mm, but may also be shorter or longer.

It is evident that the features of the first, second and/or third aspects of the invention may be combined in one pipe-cleaning device.

The invention will be further elucidated by means of the following description and the appended figures.

DETAILED DESCRIPTION OF THE PREFERRED EMBODIMENT

Figure 2:
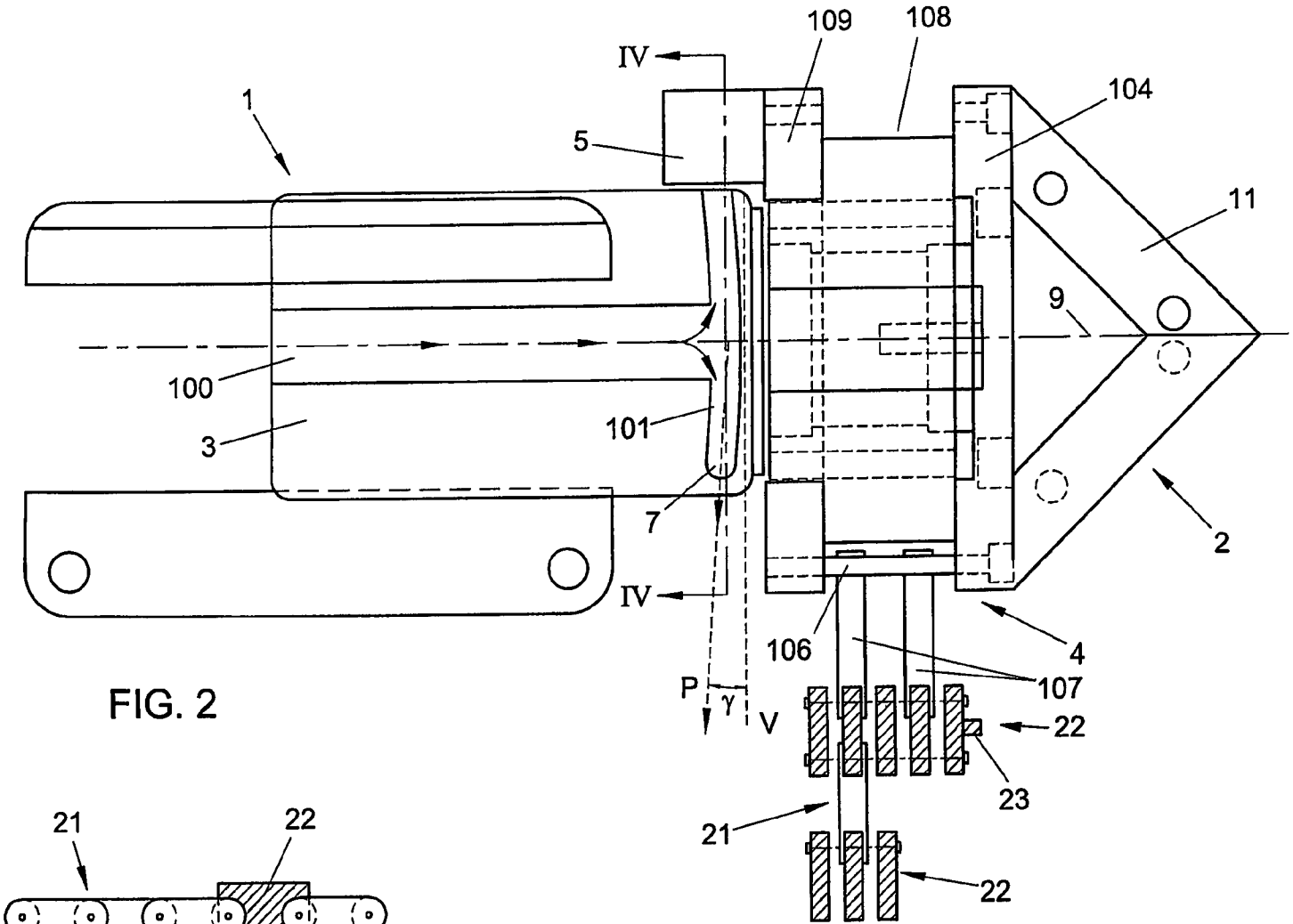
FIG. 2 shows a schematic cross sectional view of the drive and the cutting head of the device of FIG. 1.
Figure 3:
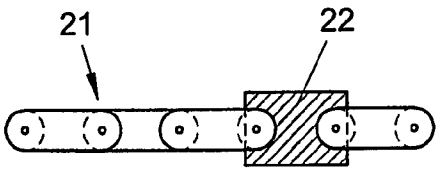
FIG. 3 shows a front view of a part of a collapsible cutting element of the cutting head according to the invention.
Figure 4:
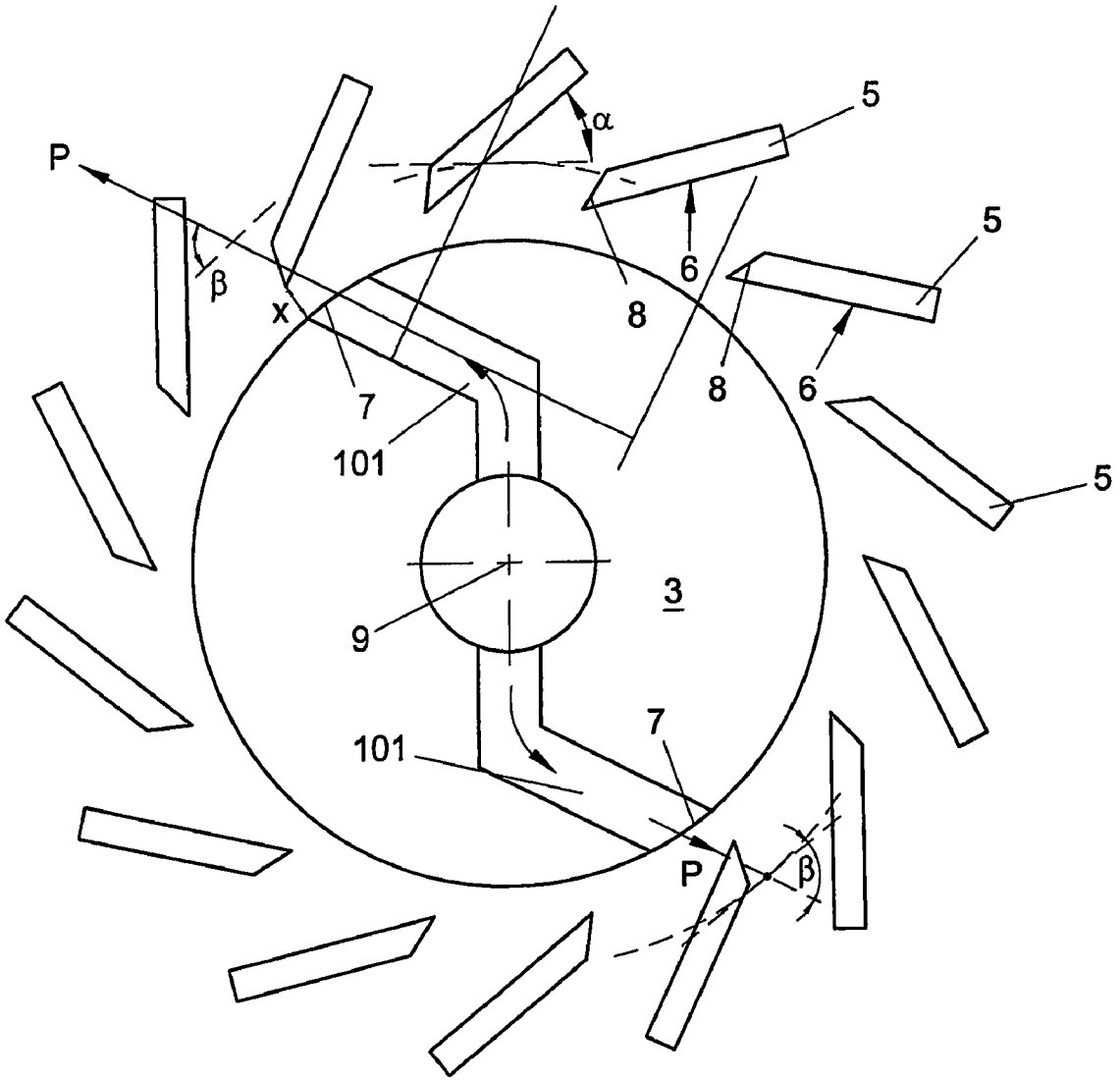
FIG. 4 shows a schematic cross section of the drive according to the invention, taken along the line IV-IV of FIG. 2.

The pipe-cleaning device 1 shown in figures is provided for cutting away undesired material from the interior of a sewage pipe. To this end, the device 1 comprises a cutting head 2, which is rotatably mounted on a body 111 about a rotation axis 9. The cutting head comprises a rigid central part 11 and collapsible cutting elements 21 for removing the undesired material. In FIG. 2, the collapsible cutting elements 21 are only partly shown. During operation, the device 1 is moved through a pipe, of which the wall W is partly shown, in a forwards direction Z.

The device 1 is provided with a drive for rotating the cutting head 2. The drive comprises a stator 3 and a rotor 4. The stator comprises a supply duct 100 which can be coupled to a supply hose (not shown) for supplying a pressurized drive liquid to the device. As shown in the figures, the supply duct 100 ends in two branches 101 which extend in opposite directions and end in nozzles 7 at the circumference of the stator 3. The rotor 4 comprises a plurality of drive elements 5 or rotor blades, which are movable along a circular path around the circumference of the stator 3. Each of these drive elements 5 is provided with a drive plane 6 facing the stator 3.

The nozzles 7 of the stator 3 are directed such that during operation the liquid, which is supplied via the duct 100 and branches 101 to the nozzles 7, forms liquid streams which drive the rotor 4. The direction of these liquid streams is shown by the arrows P. The drive elements 5 catch each of the liquid streams successively, so that the rotor 4 is forced to rotate. It is remarked that the liquid streams themselves are not shown; only the liquid flow is shown by arrows in the figures.

The rotor 4 is driven on its interior, namely by liquid streams which are generated substantially within its rotation plane V. In this way, the liquid streams are in an optimal direction for driving the rotor 4 and the drive elements 5 of the rotor are located further from the rotation axis and as far as possible towards the pipe wall W, so that a high torque can be obtained.

The device 1 is provided with such a number of drive elements 5, that each of the liquid streams substantially continuously contacts a drive element 5. In this way, the liquid streams apply a substantially continuous driving force to the rotor 4. The drive elements 5 are furthermore directed in such a way with respect to each other, that the liquid which is diverted by the drive planes 6 can easily flow between them. In order to reduce their obstruction of the liquid flow, the leading edges 8 of the drive elements are bevelled towards the respective previous drive element 5, so that the channel which is defined by one drive plane 6 and a bevelled leading edge 8 has substantially parallel walls. The flow of the liquid from the rotor 4 is further improved in that the nozzles 7 are directed slightly towards the rear end of the device 1, more particularly such that the direction P of the liquid streams forms an angle $\gamma$ of 1-20°, more particularly 2-10° with the rotation plane V of the rotor 4.

The nozzles 7 are provided for directing the liquid streams in such directions P onto the drive elements 5 that they contact the drive planes 6 in a substantially perpendicular direction. To this end, the nozzles 7 enclose an angle $\beta$ of 45-90°, more particularly 60-80°, with the circular path along which the drive elements 5 rotate during operation. The drive planes 6 enclose an angle $\alpha$ of 20-70°, more particularly 30-60°, or 40-50°, with this circular path. In this way, the liquid streams generated by the stator 3 can impart a large force on the rotor 4, so that the developed torque can be maximized.

The distance x between the leading edges 8 and the nozzles 7 is kept as short as possible for avoiding losses as a result of pressure drop when the liquid leaves the nozzles 7. To this end, the distance x is below 1 cm and preferably 1-5 mm.

Figure 1:
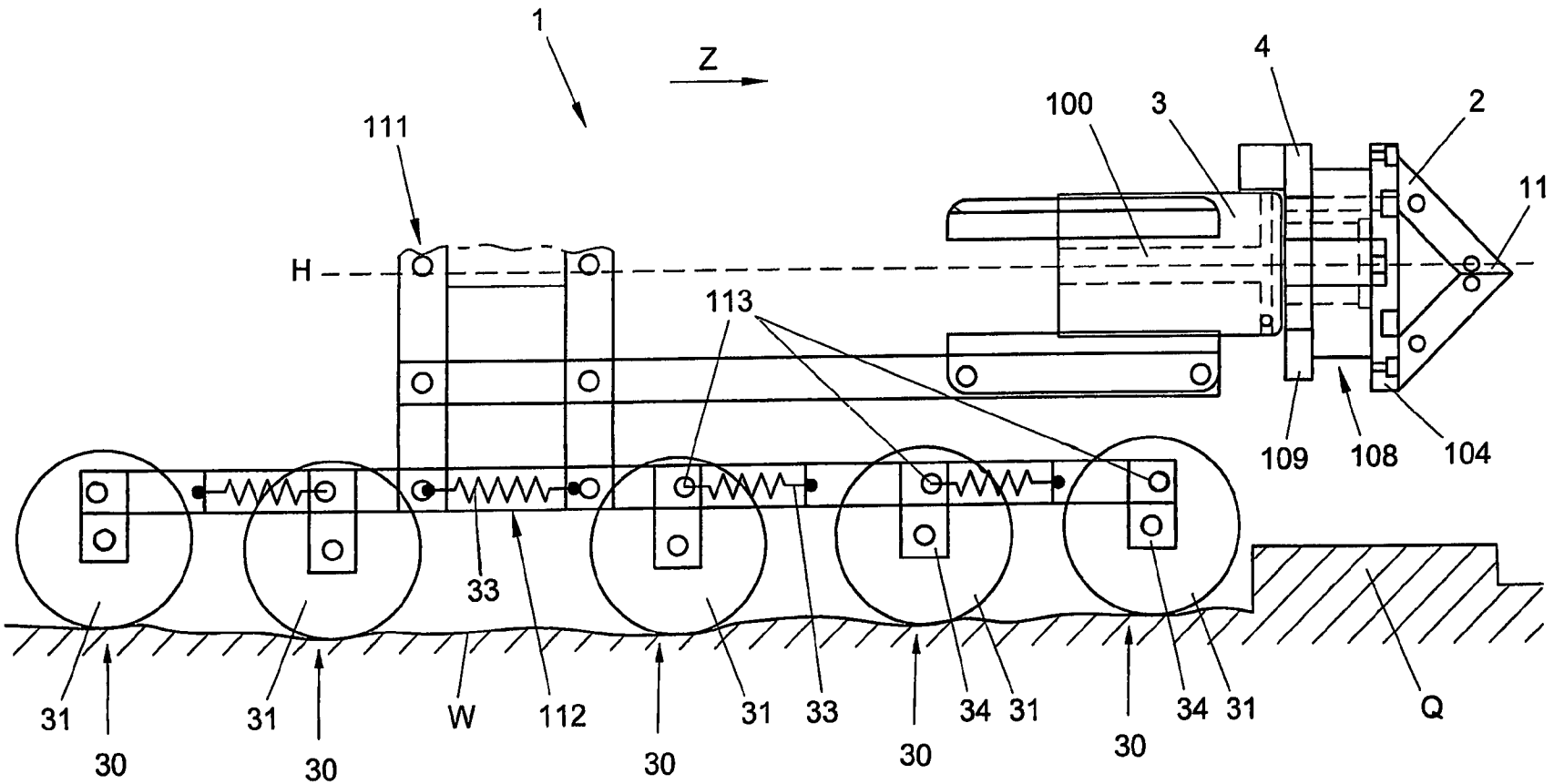
FIG. 1 shows a schematic side view of an embodiment of the pipe-cleaning device of the invention, the collapsible cutting element being removed for clarity.

The operational pressure of the liquid supplied to the device 1 of FIGS. 1 and 2 is 50-100 bar, but may also be higher or lower. The flow rate of the liquid is at least 50 l/min. The pressure and the flow rate are evidently chosen in function of the desired torque and rotation speed of the cutting head 2, which is preferably on the order of 5000 rpm.

The rigid central part 11 of the cutting head 2 of FIGS. 1 and 2 is wedge-shaped, for obtaining a cutting action when rotated at high speed. This central part 11 may however also have any other shape known to the person skilled in the art. The central part 11 may also be removably mounted on the cutting head 2, so that it is interchangeable with other central cutting parts.

On the central part 11, one or more collapsible cutting elements 21 are mounted. In FIG. 2, one collapsible cutting element 21 is shown, but there may also be less or more collapsible cutting elements 21. The collapsible cutting element 21 is a chain which is swung out by the rotor 4 during operation, so that it extends radially and undesired material which is located in the pipe can be removed by the cutting blocks 22 on the chain. These cutting blocks 22 can be provided with a cutting protrusion for enhancing the cutting action. This cutting protrusion extends forwardly from the cutting block 22 and may be carved or bevelled for avoiding a resistance build-up, which can be caused by cut material piling up at the cutting head 2.

The chain 21 comprises a plurality of cutting blocks 22, one at its end and at least one at an intermediate location between its and the pivot shaft 106 by which it is fixed to the cutting head 2. The cutting blocks 22 at the intermediate locations form mass increasing elements, which have a higher weight relative to the chain links interconnecting the cutting blocks 22. In this way, the intermediate cutting blocks 22 increase the inertia of the chain 21, so that when the outer cutting block 22 strikes an object, the chain 21 less disturbed and sooner returns to its fully extended length.

The chain parts are preferably constructed such that the mass of the chain increased towards the central part 11 of the cutting head. This means that the chain part including the outer cutting block preferably has a weight below or equal to that of an inner chain part including the intermediate cutting block.

As shown in FIG. 2, the chain 21 may comprise a frontal cutting element of a shorter length, which may be fixed to the chain or not. This shorter frontal cutting element has the advantage that the rearward deflection of the chain 21 is reduced.

The chain 21 is coupled to the cutting head 2 by means of pivot links, pivotally mounted on a pivot shaft 106 of the central part 11 of the cutting head 2. The central part 11 has a circumferential sleeve 108 in which the chain 21 can be rolled up. The sleeve 108 extends between two circumferential flanges 104, 109, which are of such height that the chain 21 can be fully accommodated in the sleeve 108 in between them. In this way, the chain 21 is a collapsible cutting element, which can collapse into the sleeve 108 for being moved past obstacles Q on the interior wall W of the pipe which is cleaned. Such an obstacle may for example result from a level difference between subsequent pipe sections. Once the chain 21 is moved past the obstacle Q, the chain 21 is again extended from the sleeve 108 as a result of centrifugal forces.

As is further shown in FIG. 1, the body 111 of the device 1 comprises support means 112 for supporting the body 111 carrying the cutting head 2 on the pipe wall W. These support means are formed by arrays 112 of collapsible support elements 30. The device 1 of FIG. 1 comprises three such arrays 112, of which one is shown. The three arrays are provided at regular distances from each other around the circumference of the body. Each array 112 comprises five collapsible support elements 30. The body may however also comprise any other number of arrays 112 with any number of collapsible support elements 30 deemed suitable by the person skilled in the art.

Each collapsible support element 30 comprises a wheel 31, an L-shaped arm 34 and a pull spring 33. The wheels 31 are mounted in a plane extending through the central axis H of the device 1, so substantially perpendicular to the pipe wall W. Each wheel 31 is rotatably mounted on its arm 34. The arm 34 is pivotally mounted on the body 111 and has a pivot axis 113 which is offset from the rotation axis of the wheel 31 in longitudinal direction of the device. This offset ensures that the support element 30 can collapse, by rotating the wheel 31 away from the pipe wall W when encountering an obstruction Q. For the front support elements 30 located at the cutting head 2, the offset is backwards, i.e., the rotation axis of the wheel 31 is behind the pivot axis 113. For the rear support elements 30, the offset is forwards. In this way, the movability of the device 1 in both forwards and backwards direction can be ensured. The pull spring 33, which extends in line with the L-shaped arm on the opposite end of the pivot axis 113 with respect to the end on which the wheel 31 is mounted, is provided for pressing the wheel 31 back onto the pipe wall W past the obstruction Q. By this construction, the device 1 can easily be moved past a narrower part in the pipe, without losing the support on the pipe wall W: when one support element 30 collapses, its supporting function is temporarily taken over by the other support elements 30 of the array 112. The resiliency of the springs 33 is predetermined, for achieving that the supporting capacity of the whole array is sufficient for still supporting the body if at least one support element 30 is collapsed. As can be understood from FIG. 1, the support elements can also all collapse towards either the front end or the rear end of the device.

The body 111 may further be adjustable, so that the distance between the arrays 112 of collapsible support elements can be adjusted and the device 1 can be adjusted to the diameter of the pipe which is to be cleaned.

The pressurised liquid which is used for driving the rotation of the rotor 4 and for propelling the device 1 in forwards direction Z through the pipe is preferably water. The device 1 is propelled forwards by means of the reaction forces of one or more propulsion jets (not shown). Evidently, the forwards propulsion can be achieved with any other propulsion means known to the person skilled in the art.

The invention claimed is:

1. A pipe-cleaning device comprising:

a cutting head for cutting away material on the interior of a pipe, a body on which the cutting head is rotatably mounted, and drive means for driving the rotation of the cutting head with respect to the body, wherein the body has a circumference where a plurality of arrays of collapsible support elements extending in a longitudinal direction of the body are mounted for supporting the body on an interior (W) of a pipe, wherein the cutting head includes one or more collapsible cutting elements which extend in a radial direction of the cutting head and are inwardly collapsible with respect to the circumference of the body; wherein the body has a front end at which the cutting head is mounted and a rear end opposite the front end; and wherein the collapsible support elements are mounted to be inwardly collapsible with respect to the circumference of the body against the action of a resilient member, the collaosible support elements at the front end being collapsible towards the rear end and the collapsible support elements at the rear end being collapsible towards the front end.

2. The pipe-cleaning device according to claim 1, wherein each collapsible support element comprises a wheel which is rotatably mounted about a rotation axis on a collapsible arm, the arm being pivotally mounted about a pivot axis on the body, the rotation axis being offset from the pivot axis in longitudinal direction of the body.

3. The pipe-cleaning device according to claim 2, wherein the resilient member is a pull spring which extends in line with the collapsible arm in an unloaded state.

4. The pipe-cleaning device according to claim 1, wherein by at least three arrays of at least three collapsible support elements, the arrays being located at regular locations on the circumference of the body.

5. The pipe-cleanin device according to claim 1, wherein the cutting head comprises at least one first collapsible cutting element which extends radially from a rigid central part, each first collapsible cutting element ending in a first cutting block and being provided with at least one mass increasing element at an intermediate location between the central part and the first cutting block.

6. The pipe-cleaning device according to claim 5, wherein each mass increasing element is formed by a second cutting block.

7. The pipe-cleaning device according to claim 5, wherein the first collapsible cutting element comprises a first chain part from the first cutting block to the mass increasing element and a second chain part from the mass increasing element to the central part, the first chain part having a weight which is smaller than or equal to that of the second chain part.

8. The pipe-cleaning device according to claim 5, wherein the cutting head further comprises at least one second collapsible cutting element in front of the at least one first collapsible cutting element, each second collapsible cutting element being of equal length or shorter than each first collapsible cutting element.

9. The pipe-cleaning device according to claim 8, wherein each second collapsible cutting element comprises a third chain part ending in a third cutting block, the third chain part being of substantially equal length with the second chain part of the first collapsible cutting elements.

10. The pipe-cleaning device according to claim 5, wherein at least one of the first, second and/or third cutting blocks is provided with a cutting protrusion which extends in forwards direction from the cutting block.

11. The pipe-cleaning device according to claim 1, wherein the drive means comprises a stator and a rotor which is rotatably mounted on the stator about a rotation axis, the stator having at least one nozzle connected to a supply duct for directing a liquid stream of a pressurised liquid supplied via the supply duct successively onto a plurality of drive elements of the rotor, wherein the at least one nozzle extends substantially within a plane (V) perpendicular to the rotation axis of the rotor and that the at least one nozzle is located inwardly from the rotor.

12. The pipe-cleaning device according to claim 11, wherein each drive element of the rotor has a drive plane for periodically receiving the liquid stream, the drive plane being directed such that the liquid stream is received in a substantially perpendicular direction (P).

13. The pipe-cleaning device according to claim 12, wherein the drive elements during operation travel along a circular path and each drive plane is directed in an angle a of 20-70 ° with respect to this circular path.

14. The pipe-cleaning device according to claim 13, wherein each nozzle is directed in an angle p of 45-90 ° with respect to the circular path of the drive elements.

15. The pipe-cleaning device according to claim 12, wherein each drive element has a leading edge which is rotated first into the liquid stream of the nozzle during operation, the leading edge being bevelled in a direction towards the drive plane of the in rotation direction previous drive element of the rotor.

16. The pipe-cleaning device according to claim 15, wherein the distance (x) between the nozzle and the leading edge of the drive elements is within the range of 1-5mm.

17. The pipe-cleaning device according to claim 1, wherein all of the collapsible supports elements are collapsible both towards the rear end and towards the front end.

* * * * *